US006491327B1

(12) United States Patent
Fan

(10) Patent No.: US 6,491,327 B1
(45) Date of Patent: Dec. 10, 2002

(54) DOOR LEVER HANDLE ASSEMBLY

(76) Inventor: Fang-Yi Fan, No. 186, Min-Kuo Rd., Chia-Yi City (TW)

( * ) Notice: Subject to any disclaimer, the term of this patent is extended or adjusted under 35 U.S.C. 154(b) by 0 days.

(21) Appl. No.: 10/039,327

(22) Filed: Nov. 9, 2001

(51) Int. Cl.[7] ..... E05C 1/12
(52) U.S. Cl. ..... 292/165; 292/165.21; 292/336.3
(58) Field of Search ..... 292/165, 140, 292/169, 347, 336.3, 169.21

(56) References Cited

U.S. PATENT DOCUMENTS 4,982,986 A * 1/1991 Gressett, Jr. et al. .... 292/336.3
5,624,141 A * 4/1997 Kuo et al. ..... 292/165
5,664,816 A * 9/1997 Nigro, Jr. et al. ..... 292/336.3
6,174,005 B1 * 1/2001 Norton ..... 292/169.21
6,302,453 B1 * 10/2001 Norton ..... 292/169.21

* cited by examiner

*Primary Examiner*—Teri Pham Luu
(74) *Attorney, Agent, or Firm*—Ladas & Parry

(57) ABSTRACT

In a door lever handle assembly, a latch bolt is movable between extended and retracted positions and is coupled operably to a spindle having opposite ends respectively and non-rotatably coupled to outside and inside lever handles. Operation of either one of the outside and inside lever handles causes actuating parts of a force transmitting member disposed on the spindle to disengage one of left and right force bearing parts of a sliding seat mounted inwardly of and slidably on one of the outside and inside lever handles and to push the other of the left and right force bearing parts against action of a biasing unit.

8 Claims, 6 Drawing Sheets

DOOR LEVER HANDLE ASSEMBLY

BACKGROUND OF THE INVENTION

1. Field of the Invention

The invention relates to a door lever handle assembly, more particularly to a door lever handle assembly that can be adapted for mounting on both left-hand and right-hand doors in a convenient manner.

2. Description of the Related Art

A door lever handle assembly for controlling opening and closing of a door generally includes an outside lever handle mounted on an outer side of a door panel, an inside lever handle mounted on an inner side of the door panel, and a latch bolt mechanism mounted inside the door panel. When the outside lever handle of a door lever handle assembly mounted on a left-hand door is turned in a first direction to retract a latch bolt into the door panel, the inside lever handle on the other side of the door panel turns in an opposite second direction, and vice versa. The outside and inside lever handles of the door lever handle assembly would turn in reverse directions when the assembly is applied to a right-hand door. On the other hand, mechanisms for restoring the outside and inside lever handles to their original positions after operation of the outside or inside lever handle act in different directions. In view of this, manufacturers in the past had to form four structurally similar restoring mechanisms but of different specifications in order to adapt a door lever handle assembly for application to both left-hand doors and right-hand doors, which is inconvenient in terms of manufacture and assembly.

SUMMARY OF THE INVENTION

Therefore, the main object of the present invention is to provide a door lever handle assembly which can be mounted on either a left-hand door or a right-hand door and which is convenient to manufacture and assemble.

Accordingly, a door lever handle assembly of this invention is adapted to be mounted on a door panel having an outer side, an inner side, and a lateral connecting side interconnecting the outer and inner sides. The door lever handle assembly includes:

an outside lever handle unit including an outside mounting cap adapted to be mounted on the outer side of the door panel, and an outside lever handle having a coupling end coupled rotatably to the outside mounting cap;

an inside lever handle unit including an inside mounting cap adapted to be mounted on the inner side of the door panel, and an inside lever handle having a coupling end coupled rotatably to the inside mounting cap;

a latch bolt mechanism adapted to be mounted inside the door panel and including a latch bolt that is movable between an extended position, where the latch bolt is adapted to project from the connecting side of the door panel, and a retracted position, where the latch bolt is adapted to retract into the door panel, and a spindle operably coupled to the latch bolt such that axial rotation of the spindle results in movement of the latch bolt between the extended and retracted positions, the spindle having opposite ends coupled respectively and non-rotatably to the coupling ends of the outside and inside lever handles such that operation of either one of the outside and inside lever handles can result in movement of the latch bolt from the extended position to the retracted position; and a restoring mechanism including a force transmitting member provided on the spindle and having left and right actuating parts, a sliding seat mounted slidably on one of the outside and inside mounting caps, and having left and right force bearing parts disposed respectively adjacent to the left and right actuating parts, and a biasing unit for biasing the sliding seat toward the force transmitting member such that the left and right force bearing parts abut against the left and right actuating parts at the same time;

wherein operation of one of the outside and inside lever handles for moving the latch bolt from the extended position to the retracted position causes one of the left and right actuating parts to disengage the respective one of the left and right force bearing parts, and further causes the other of the left and right actuating parts to push the respective one of the left and right force bearing parts against action of the biasing unit, thereby storing a restoring force in the biasing unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
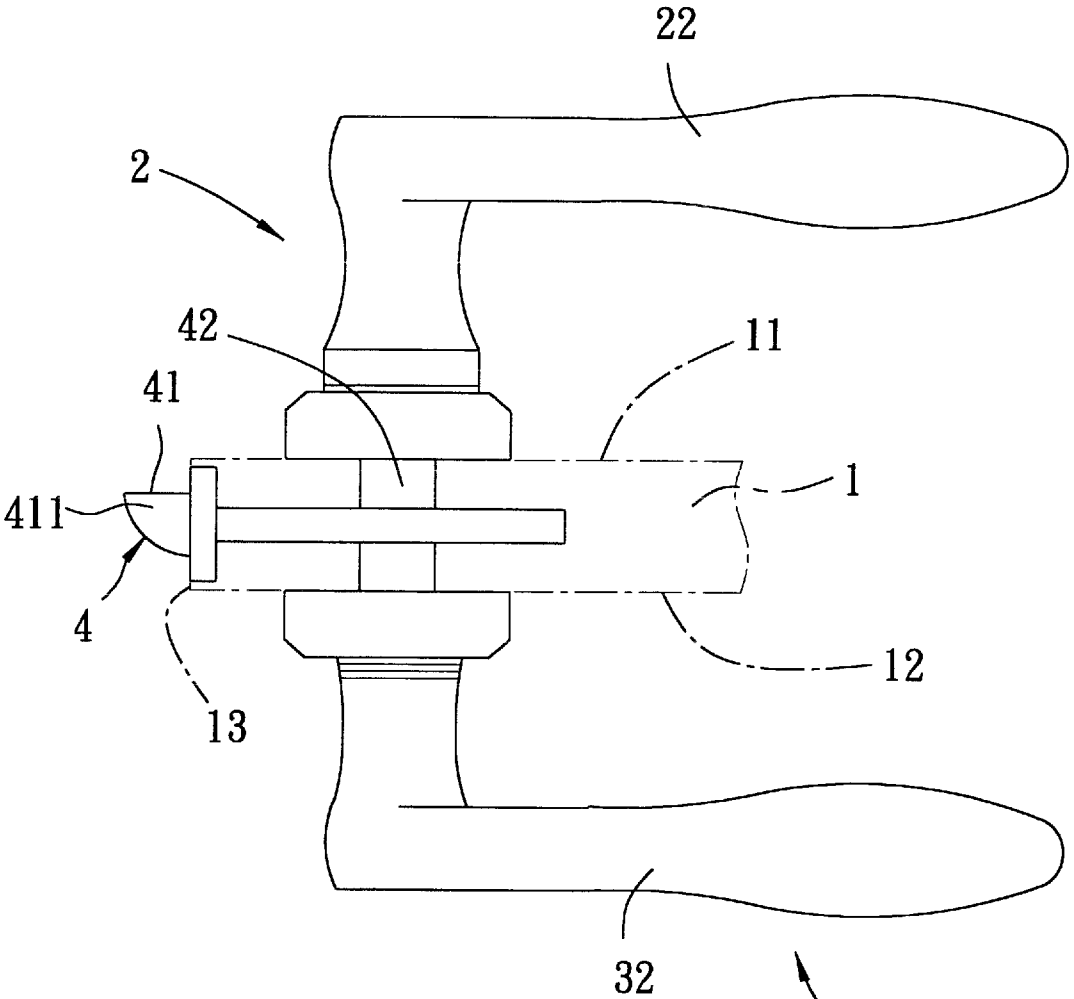
FIG. 1 is a top view of a preferred embodiment of a door lever handle assembly according to the invention in an assembled state, showing how the preferred embodiment is mounted on a right-hand door.
Figure 2:
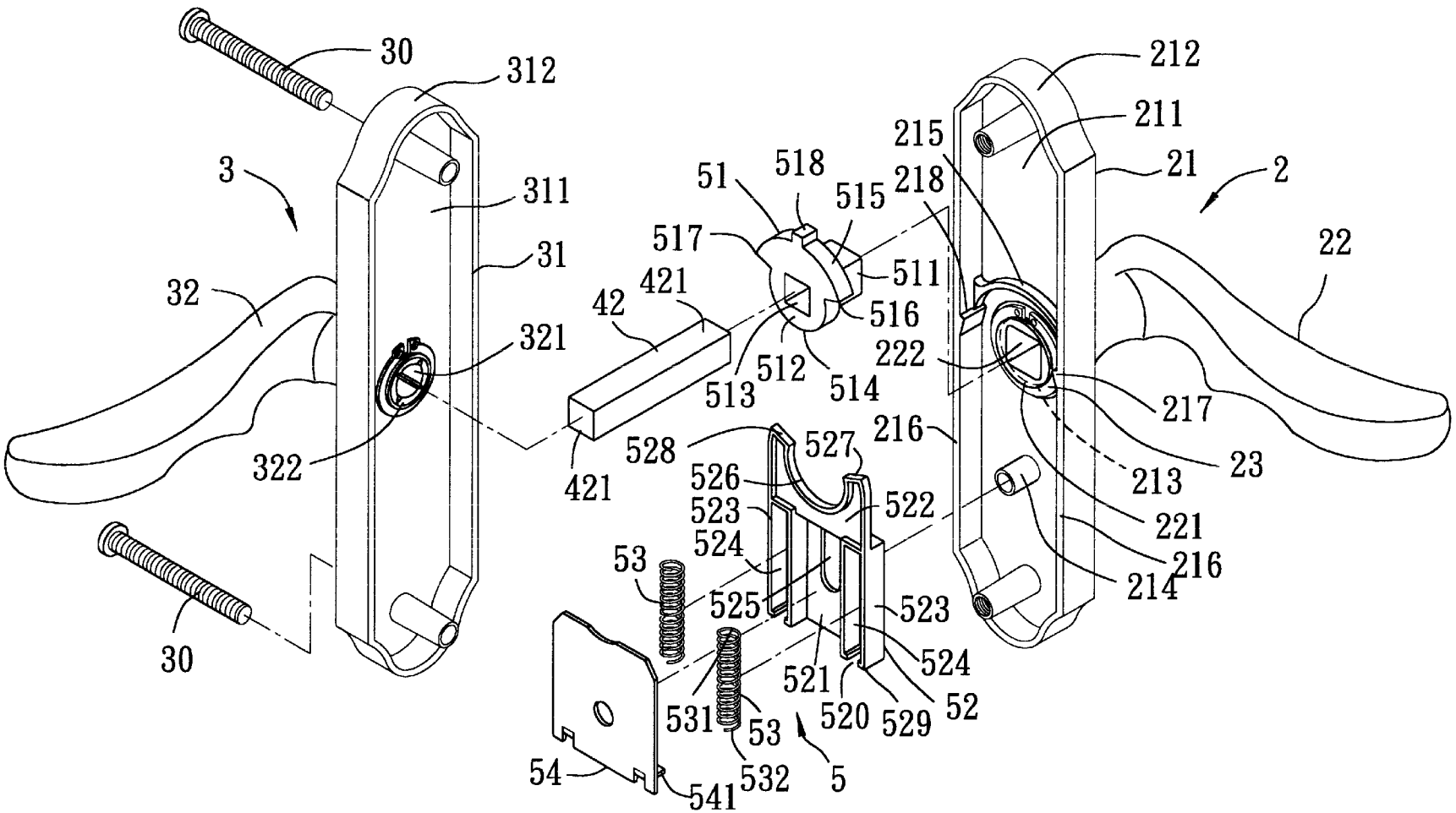
FIG. 2 is an exploded perspective view of the preferred embodiment, with a latch bolt mechanism omitted for the sake of clarity.

Referring to FIGS. 1 and 2, the preferred embodiment of a door lever handle assembly according to the present invention is adapted to be mounted on a door panel 1 having an outer side 11, an inner side 12, and a lateral connecting side 13 interconnecting the outer and inner sides 11, 12. As shown, the door lever handle assembly includes outside and inside lever handle units 2, 3, a latch bolt mechanism 4, and a restoring mechanism 5.

The outside lever handle unit 2 includes an outside mounting cap 21 adapted to be mounted on the outer side 11 of the door panel 1, an outside lever handle 22 having a coupling end 221, and a coupling ring 23 for coupling the coupling end 221 rotatably to the outside mounting cap 21. The outside mounting cap 21 includes an elongate plate body 211 having a length in a longitudinal direction, and a peripheral flange 212 extending from a periphery of the plate body 211 in a transverse direction that is transverse to the longitudinal direction toward the outer side 11. The plate body 211 is formed with a coupling hole 213 for coupling rotatably with the coupling end 221 of the outside lever handle 22, a guide post 214 that extends in the transverse direction, and a curved projection 215 that is disposed at a level above and that is concentric with the coupling hole 213. The coupling end 221 is formed with a four-sided hole 222. The peripheral flange 212 has a parallel pair of limiting sections 216 that are disposed at a level below the coupling hole 213. The peripheral flange 212 is formed with a pair of inward limit projections 218, 217 disposed respectively at left and right sides of the coupling hole 213 above the limiting sections 216.

The inside lever handle unit 3 is adapted to be mounted on the inner side 12 of the door panel 1 and is coupled to the outside lever handle unit 2 by fasteners 30. The inside lever handle unit 3 has a construction substantially similar to that of the outside lever handle unit 2, and includes an inside mounting cap 31 adapted to be mounted on the inner side 12 of the door panel 1 opposite to the outside mounting cap 21. The inside mounting cap 31 includes an elongate longitudinally extending plate body 311 and a transversely extending peripheral flange 312. An inside lever handle 32 having a coupling end 322 is coupled rotatably to the inside mounting cap 31. The coupling end 322 is formed with a spindle hole 321 corresponding to the four-sided hole 222.

The latch bolt mechanism 4 is adapted to be mounted inside the door panel 1, and includes a latch bolt 41 having a latch head 411 that is movable between an extended position, where the latch head 411 of the latch bolt 41 is adapted to project from the connecting side 13 of the door panel 1, and a retracted position, where the latch head 411 of the latch bolt 41 is adapted to retract into the door panel 1, and a spindle 42 operably coupled to the latch bolt 41 such that axial rotation of the spindle 41 results in movement of the latch head 411 of the latch bolt 41 between the extended and retracted positions. The spindle 42 has a generally square cross-section, and has opposite ends 421 to be coupled respectively and non-rotatably to the coupling ends 221, 322 of the outside and inside lever handles 22, 32 such that operation of either one of the outside and inside lever handles 22, 32 can result in movement of the latch head 411 of the latch bolt 41 from the extended position to the retracted position. Since the latch bolt mechanism 4 has a conventional configuration, and since the connection between the spindle 42 and the latch bolt 41 is not pertinent to the present invention, a detailed description thereof is dispensed with herein for the sake of brevity.

Figure 3:
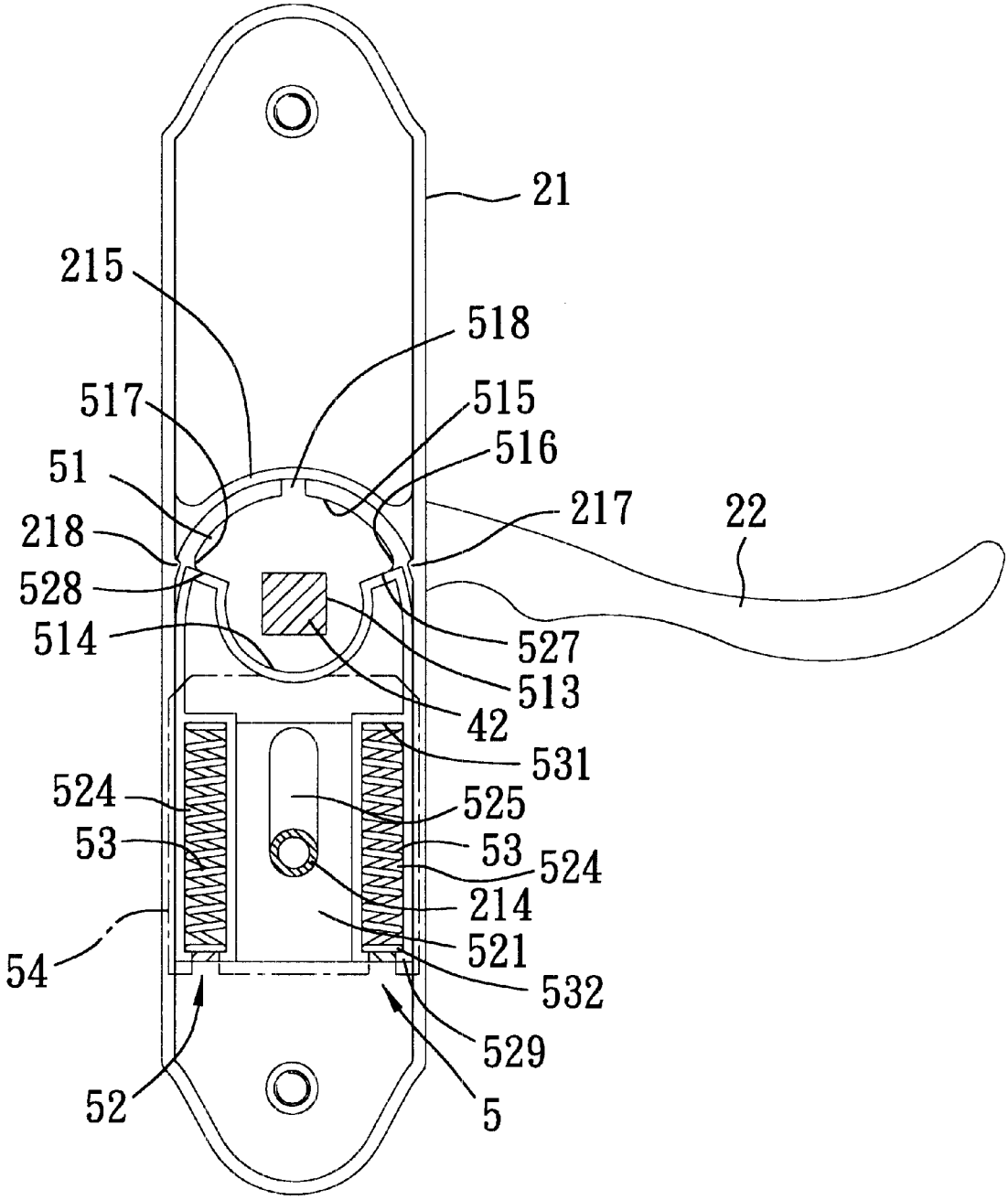
FIG. 3 is an assembled front view of the preferred embodiment in part, illustrating a restoring mechanism in a non-operated state.

Referring to FIGS. 2 and 3, the restoring mechanism 5 includes a force transmitting member 51 provided on the spindle 42 and having left and right actuating parts 517, 516, a sliding seat 52 mounted slidably on one of the outside and inside mounting caps 21, 31, and having left and right force bearing parts 528, 527 disposed respectively adjacent to the left and right actuating parts 517, 516, and a biasing unit for biasing the sliding seat 52 toward the force transmitting member 51 such that the left and right force bearing parts 528, 527 abut against the left and right actuating parts 517, 516 at the same time. In this embodiment, the biasing unit includes a pair of coiled compression springs 53, each of which has a seat abutting end 531 and a cover abutting end 532 opposite to the seat abutting end 531.

The force transmitting member 51 has a coupling portion 512 formed with a coupling projection 511 for engaging non-rotatably the coupling end 221, 322 of the respective one of the outside and inside lever handles 22, 32. In this embodiment, the coupling projection 511 engages the four-sided hole 222 in the coupling end 221. A blind spindle hole 513 is formed in the coupling portion 512 for engaging non-rotatably one of the ends 421 of the spindle 42. A cam projection 515 projects radially and outwardly relative to the coupling portion 512, and has angularly spaced apart ends that are formed with the left and right actuating parts 517, 516. During manufacture, the force transmitting member 51 and the spindle 42 can be formed integrally. The coupling portion 512 further has a curved bottom surface 514 that is concentric with a center of the blind spindle hole 513 and that has left and right ends connected to the cam projection 515 proximate to the left and right actuating parts 517, 516. In addition, the force transmitting member 51 is formed with a limiting flange 518 that projects radially from the cam projection 515 between the left and right actuating parts 517, 516, that is disposed between the limit projections 218, 217 in a non-operated state of either of the outside and inside lever handles 22, 32, and that abuts against one of the limit projections 218, 217 to limit extent of angular rotation of the spindle 42 when one of the outside and inside lever handles 22, 32 is operated.

The sliding seat 52 includes a base plate 521 slidably confined between the limiting sections 216, an extension plate 522 extending longitudinally from an upper end of the base plate 521, and left and right pairs of ribs 523 extending transversely from one side of the base plate 521 to respectively define two spring receiving grooves 524 therebetween in one side of the base plate 521 for accommodating the compression springs 53, respectively. The base plate 521 is formed with an elongate slide hole 525 that extends in the longitudinal direction and that permits extension of the guide post 214 through the sliding seat 52. The guide post 214 and the slide hole 525 cooperate to limit extent of sliding movement of the sliding seat 52 in the longitudinal direction between the limiting sections 216. The extension plate 522 has a curved upper surface 526 that matches the contour of the curved bottom surface 514 of the coupling portion 512, and left and right upper ends that are respectively disposed on two sides of the curved upper surface 526 and that serve as the left and right force bearing parts 528, 527. The ribs 523 in a respective one of the left and right pairs respectively have bottom ends that extend toward each other to form cover supporting flanges 529, which confine an opening 520 therebetween. The restoring mechanism 5 further includes a cover plate 54 disposed to cover the spring receiving grooves 524 and secured to said one of the outside and inside mounting caps 21, 31. In this embodiment, the cover plate 54 is formed with a hole for extension of the guide post 214. The guide post 214 is malleated such that the cover plate 54 is riveted on the plate body 211. The cover plate 54 is formed with a pair of spring supporting flanges 541 that extend respectively into the spring receiving grooves 524 to close the openings 520, respectively. Each of the spring supporting flanges 541 has the cover abutting end 532 of a respective one of the compression springs 53 abutting there against. The seat abutting ends 531 of the compression springs 53 abut against the base plate 521 at one end of the respective one of the spring receiving grooves 524.

In the invention, operation of one of the outside and inside lever handles 22, 32 for moving the latch bolt 41 from the extended position to the retracted position causes one of the left and right actuating parts 517, 516 to disengage the respective one of the left and right force bearing parts 528, 527, and further causes the other of the left and right actuating parts 517, 516 to push the respective one of the left and right force bearing parts 528, 527 against action of the compression springs 53, thereby storing a restoring force in the compression springs 53.

With further reference to FIGS. 1 and 3, when the door panel 1 on which the door lever handle assembly of the invention is mounted is a right-hand one, under the condition that the outside and inside lever handles 22, 32 are not operated, the outside and inside lever handles 22, 32 both remain in a substantially level position since the sliding seat 52 is urged upward by the compression springs 53 such that the left and right actuating parts 517, 516 engage the left and right force bearing parts 528, 527 at the same time, respectively.

Figure 4:
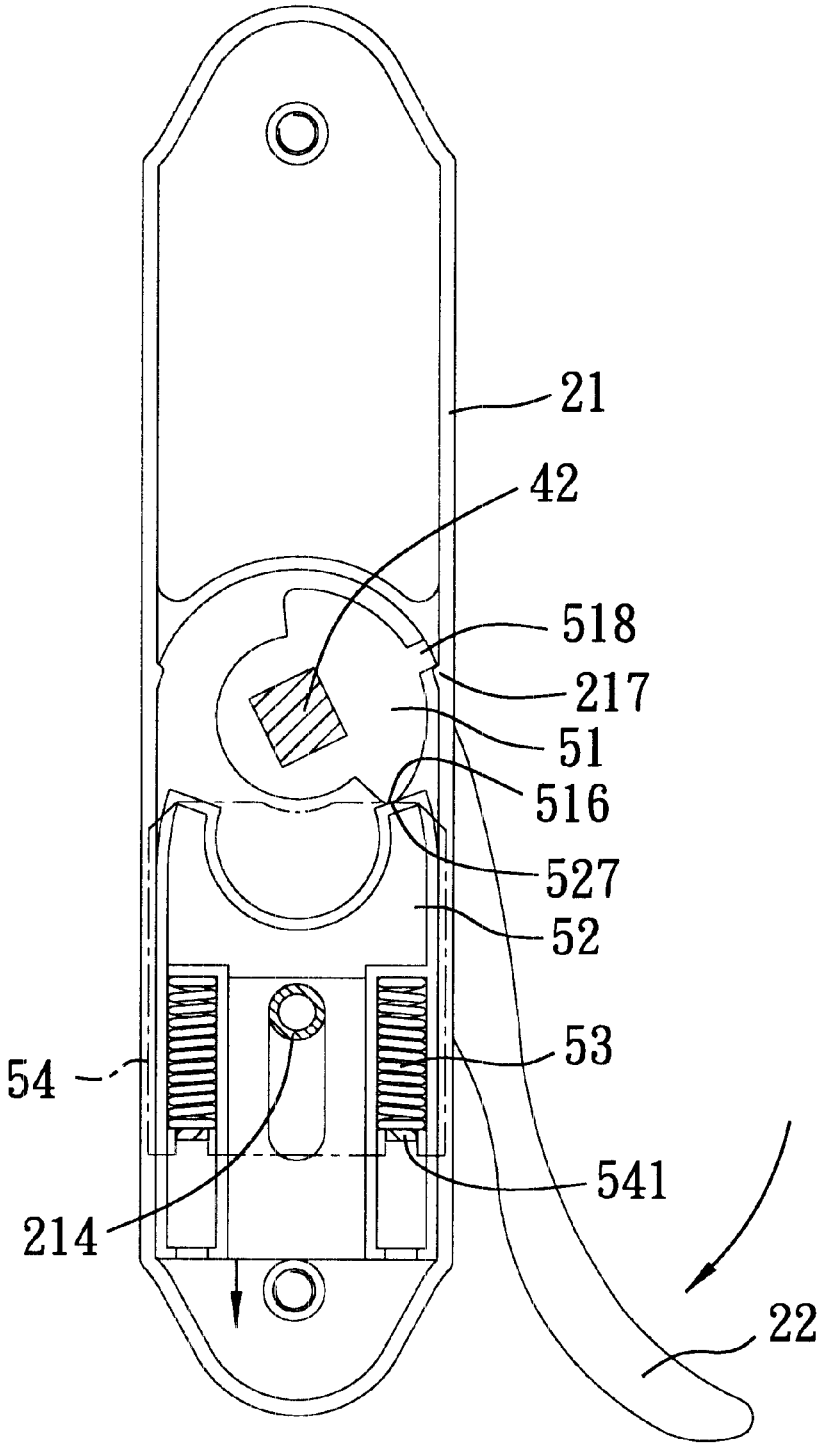
FIG. 4 is a view similar to FIG. 3, illustrating operation of the restoring mechanism when an outside lever handle is operated clockwise.

Referring to FIGS. 1 and 4, when the user applies a force to press the outside lever handle 22 to rotate in a clockwise direction, due to the angular rotation of the spindle 42 that is coupled non-rotatably to the coupling ends 221, 322 of the outside and inside lever handles 22, 33, the force transmitting member 51 and the inside lever handle 32 will be brought to rotate therewith. Clockwise rotation of the force transmitting member 51 will bring the left actuating part 517 to disengage from the left force bearing part 528 and causes the right actuating part 516 to push the force bearing part 527 downward against biasing action of the compression springs 53 until the limiting flange 518 abuts against the limit projection 217. At this time, the latch head 411 of the latch bolt 41 that is coupled to the spindle 42 will be brought to retract inwardly of the lateral connecting side 13 into the door panel 1 in a known manner. When the outside lever handle 22 is released, the force stored in the compressed compression springs 53 will urge the sliding seat 52 upward to thereby restore the sliding seat 52 to the original position. At the same time, the right force bearing part 527 which abuts against the right actuating part 516 will restore the force transmitting member 51 to the original position thereof. Thus, the outside and inside lever handles 22, 32 will return to their level position.

For the same reasons, if the force is applied to the inside lever handle 32, although the direction of turning of the inside lever handle 32 is in reverse with respect to the user, the direction of rotation of the force transmitting member 51 is also clockwise with respect to the door lever handle assembly. That is, the right actuating part 516 of the force transmitting member 51 will push the right force bearing part 527 of the sliding seat 52 when either one of the outside and inside lever handles 22, 32 is operated.

Figure 5:
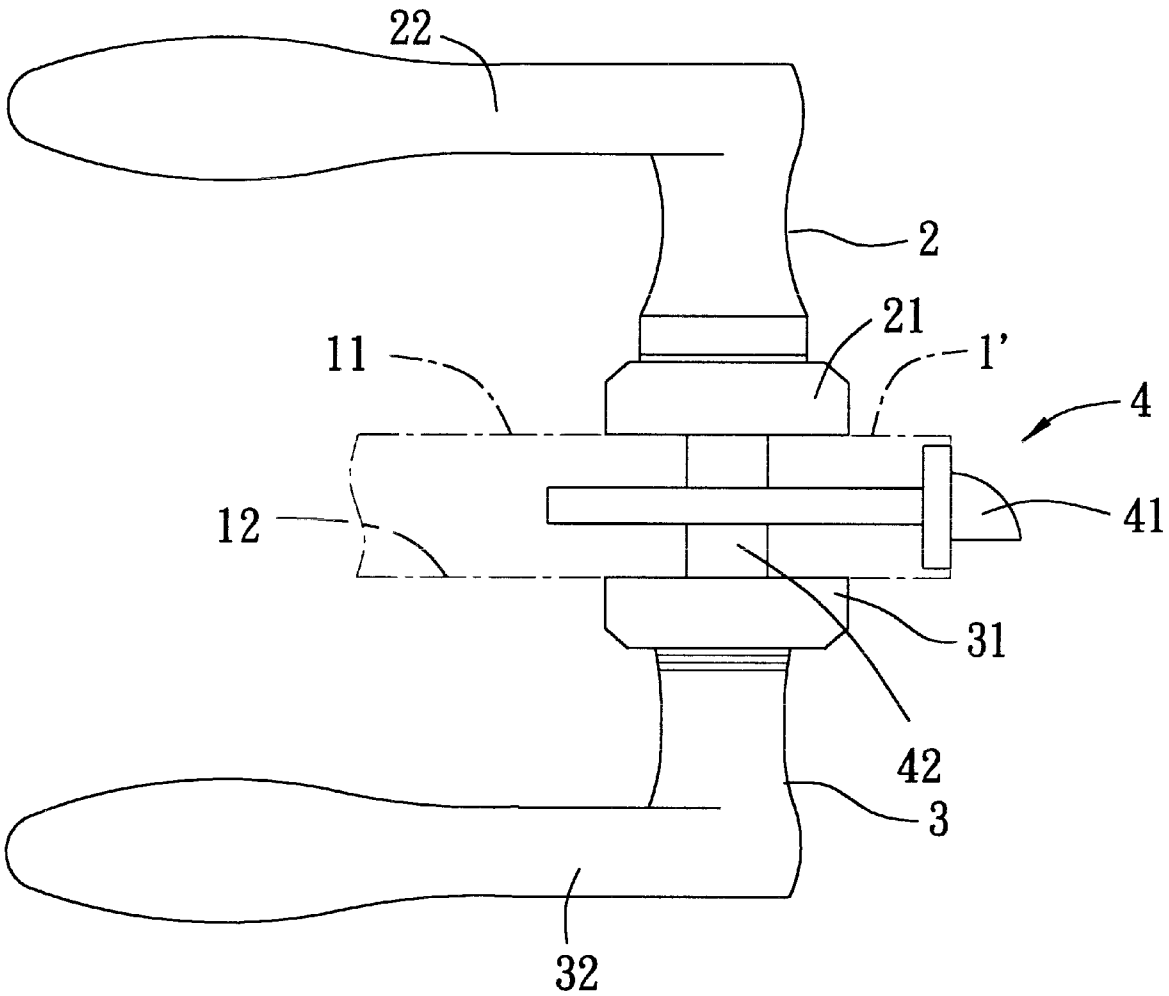
FIG. 5 is a top view of the preferred embodiment when mounted on a left-hand door.
Figure 6:
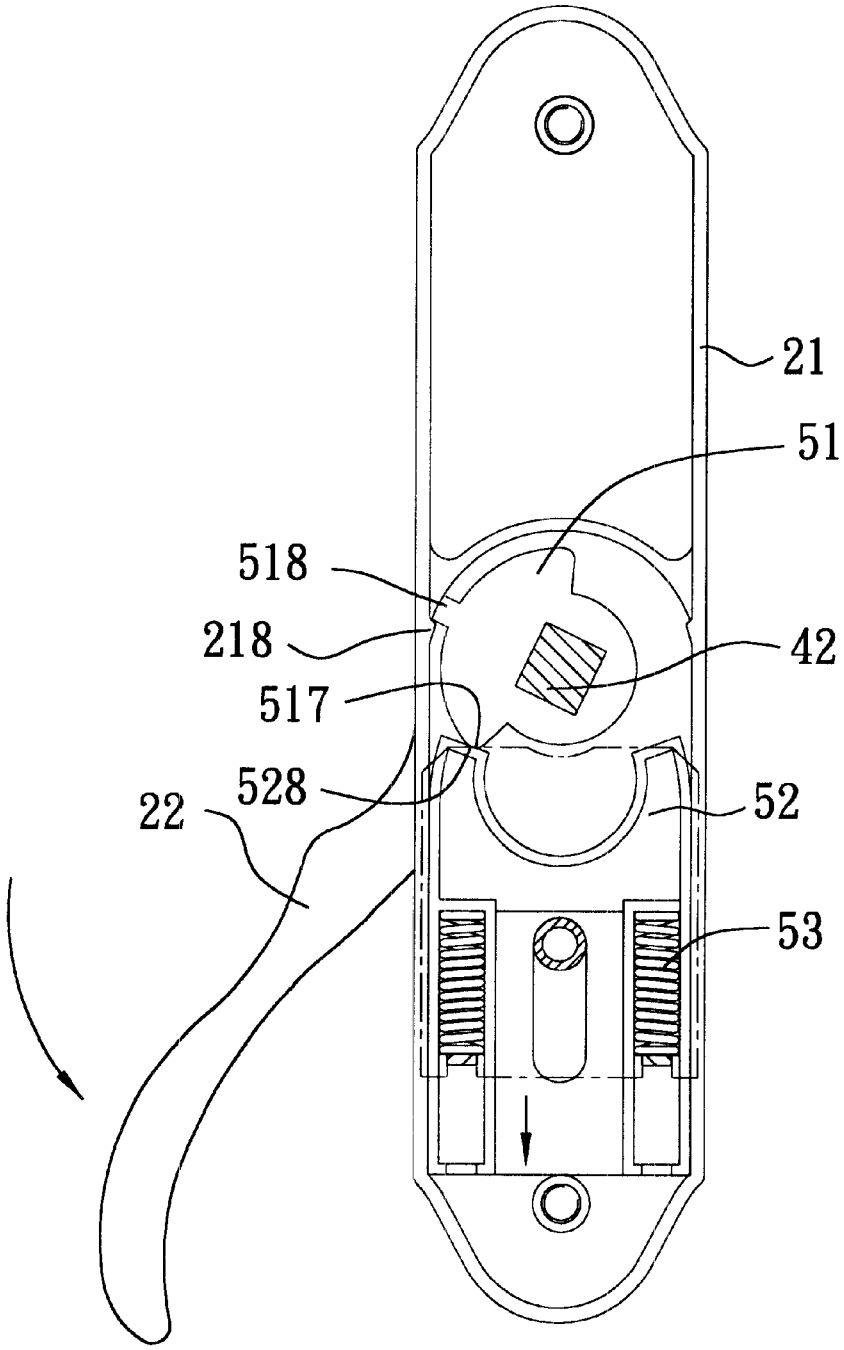
FIG. 6 is a view similar to FIG. 3, illustrating operation of the restoring mechanism when the outside lever handle is operated counterclockwise.

Referring to FIGS. 5 and 6, when the door lever handle assembly of the invention is mounted on a left-hand door panel 1', the assembly procedures are the same. That is, the outside lever handle unit 2 is mounted on the outer side 11 of the door panel 1', whereas the inside lever unit 1 is mounted on the inner side 12 of the door panel 1'. As the door panel 1' is opened to the left instead of to the right, the outside and inside lever handles units 2, 3 are shown to extend toward the left side in FIG. 5. During operation, when the outside lever handle 22 is turned in the counterclockwise direction, by virtue of the spindle 42 which is coupled to the latch bolt 41, the force transmitting member 51 of the restoring mechanism 5 can be brought to rotate counterclockwise until the limiting flange 518 is checked by the left limiting projection 218. At this time, the force transmitting member 51 will push the sliding seat 52 downward against the biasing action of the compression springs 53. The restoring force thus stored in the compression springs 53 will urge the sliding seat 52 to restore the same to its original position after the force applied to the outside lever handle 22 is released, thereby restoring the outside and inside lever handles 22, 32 to the level position once again.

It can be appreciated from the aforesaid that the door lever handle assembly of the invention can be adapted for mounting on either a right-hand door or a left-hand door. In addition, the present invention is simple in construction to result in lower manufacturing costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A door lever handle assembly adapted to be mounted on a door panel having an outer side, an inner side, and a lateral connecting side interconnecting the outer and inner sides, said door lever handle assembly comprising:

an outside lever handle unit including an outside mounting cap adapted to be mounted on the outer side of the door panel, and an outside lever handle having a coupling end coupled rotatably to said outside mounting cap;

an inside lever handle unit including an inside mounting cap adapted to be mounted on the inner side of the door panel, and an inside lever handle having a coupling end coupled rotatably to said inside mounting cap;

a latch bolt mechanism adapted to be mounted inside the door panel and including a latch bolt that is movable between an extended position, where the latch bolt is adapted to project from the connecting side of the door panel, and a retracted position, where the latch bolt is adapted to retract into the door panel, and a spindle operably coupled to said latch bolt such that axial rotation of said spindle results in movement of said latch bolt between the extended and retracted positions, said spindle having opposite ends coupled respectively and non-rotatably to said coupling ends of said outside and inside lever handles such that operation of either one of said outside and inside lever handles can result in movement of said latch bolt from the extended position to the retracted position; and a restoring mechanism including a force transmitting member provided on said spindle and having left and right actuating parts, a sliding seat mounted slidably on one of said outside and inside mounting caps, and having left and right force bearing parts disposed respectively adjacent to said left and right actuating parts, and a biasing unit for biasing said sliding seat toward said force transmitting member such that said left and right force bearing parts abut against said left and right actuating parts at the same time;

wherein operation of one of said outside and inside lever handles for moving said latch bolt from the extended position to the retracted position causes one of said left and right actuating parts to disengage the respective one of said left and right force bearing parts, and further causes the other of said left and right actuating parts to push the respective one of said left and right force bearing parts against action of said biasing unit, thereby storing a restoring force in said biasing unit.

2. The door lever handle assembly as claimed in claim 1, wherein said one of said outside and inside mounting caps includes an elongate plate body having a length in a longitudinal direction, and a peripheral flange extending from a periphery of said plate body in a transverse direction that is transverse to the longitudinal direction, said plate body being formed with a coupling hole for coupling rotatably with the respective one of said outside and inside lever handles, said peripheral flange having a pair of limiting sections that are disposed at a level below said coupling hole and that enable sliding movement of said sliding seat in the longitudinal direction therebetween.

3. The door lever handle assembly as claimed in claim 2, wherein said peripheral flange is formed with a pair of inward limit projections disposed respectively at left and right sides of said coupling hole, said force transmitting member being formed with a limiting flange that is disposed between said limit projections in a non-operated state of either of said outside and inside lever handles, and that abuts against one of said limit projections to limit extent of angular rotation of said spindle when one of said outside and inside lever handles is operated.

4. The door lever handle assembly as claimed in claim 2, wherein said plate body is formed with a guide post that extends in the transverse direction, said sliding seat being formed with an elongate slide hole that extends in the longitudinal direction and that permits extension of said guide post through said sliding seat, said guide post and said slide hole cooperating to limit extent of sliding movement of said sliding seat in the longitudinal direction.

5. The door lever handle assembly as claimed in claim 2, wherein said force transmitting member has a coupling portion formed with a coupling projection for engaging non-rotatably said coupling end of one of said outside and inside lever handles, a cam projection projecting radially and outwardly relative to said coupling portion and formed with said left and right actuating parts, and a blind spindle hole for engaging non-rotatably one of said ends of said spindle.

6. The door lever handle assembly as claimed in claim 5, wherein said cam projection has angularly spaced apart ends that serve as said left and right actuating parts.

7. The door lever handle assembly as claimed in claim 1, wherein said sliding seat includes a base plate formed with said left and right force bearing parts, said base plate further having one side formed with a pair of spring receiving grooves, said biasing unit including a pair of coiled compression springs disposed respectively in said spring receiving grooves.

8. The door lever handle assembly as claimed in claim 7, wherein each of said compression springs has a seat abutting end abutting against said base plate at one end of the respective one of said spring receiving grooves, and a cover abutting end opposite to said seat abutting end, said restoring mechanism further including a cover plate disposed to cover said spring receiving grooves and secured to said one of said outside and inside mounting caps, said cover plate being formed with a pair of spring supporting flanges that extend respectively into said spring receiving grooves, each of said spring supporting flanges having said cover abutting end of a respective one of said compression springs abutting there against.

* * * * *